US007967669B2

(12) United States Patent
Baik

(10) Patent No.: US 7,967,669 B2
(45) Date of Patent: Jun. 28, 2011

(54) VARIABLE AIR VOLUME CONTROL APPARATUS

(76) Inventor: Wan-Ki Baik, Seoul (KR)

( * ) Notice: Subject to any disclaimer, the term of this patent is extended or adjusted under 35 U.S.C. 154(b) by 1035 days.

(21) Appl. No.: 11/715,255

(22) Filed: Mar. 7, 2007

(65) Prior Publication Data

US 2007/0218830 A1 Sep. 20, 2007

(30) Foreign Application Priority Data

Mar. 8, 2006 (KR) ..... 10-2006-0021949

(51) Int. Cl.
*F24F 7/007* (2006.01)

(52) U.S. Cl. ..... 454/234; 454/333

(58) Field of Classification Search ..... 454/234, 454/333

See application file for complete search history.

(56) References Cited

U.S. PATENT DOCUMENTS 4,688,472 A * 8/1987 Inglis ..... 454/333
4,934,397 A * 6/1990 Niemela et al. ..... 137/1
5,333,835 A 8/1994 Smith et al.
6,010,114 A * 1/2000 Moore et al. ..... 251/306
6,698,445 B2 * 3/2004 Zelczer ..... 137/15.17
6,698,717 B1 * 3/2004 Brookshire et al. ..... 251/305
7,513,823 B1 * 4/2009 Dix ..... 454/333

FOREIGN PATENT DOCUMENTS

JP 2002228250 A * 8/2002
KR 20-0376799 2/2005

* cited by examiner

*Primary Examiner* — Steven B McAllister
*Assistant Examiner* — Samantha A Miller
(74) *Attorney, Agent, or Firm* — Paul M. Denk

(57) ABSTRACT

The invention relates to a variable air volume control apparatus which compensates an open area ratio to be in direct proportion to an opening ratio at a low opening ratio range according to an open angle of a damper blade to achieve accurate and precise air volume control. The variable air volume control apparatus includes a damper blade disposed rotatably within the duct for opening or closing an air flow path and an actuator for rotating the damper blade. The apparatus also includes an air flow path expansion mechanism having a curved surface for expanding the air flow path in accordance with an open angle of the damper blade. The invention allows obtaining the open area ratio in direct proportion to the opening ratio at the low opening ratio range through simple structural improvements, thereby improving linear characteristics of an air volume change ratio with respect to the opening ratio to more accurately and precisely control the air volume.

16 Claims, 11 Drawing Sheets

VARIABLE AIR VOLUME CONTROL APPARATUS

CLAIM OF PRIORITY

This application claims the benefit of Korean Patent Application No. 2006-21944 filed on Mar. 8, 2006, in the Korean Intellectual Property Office, the disclosure of which is incorporated herein by reference.

BACKGROUND OF THE INVENTION

1. Field of the Invention

The present invention relates to a variable air volume control apparatus for adjusting the volume of air supplied indoors appropriately in accordance with a set temperature of a room thermometer.

2. Description of the Related Art

In general, a variable air volume control apparatus is an important component in a variable air volume control system, which adjusts air volume to change room temperature, thereby maintaining pleasant indoor environment as well as preserving energy.

In such a variable air volume control apparatus, an air volume change ratio curve in accordance with an opening ratio of a damper is an important factor for adjusting the air volume according to temperature change indoors.

Therefore, the present invention aims to significantly improve the air volume change ratio curve such that it is changed from a conventional non-linear form to a linear form to realize precise control of the air volume.

FIGS. 1 and 2 illustrate a conventional variable air volume control apparatus, in which a circular plate-shaped damper blade construction 230, hereinafter referred to more simply as a damper blade or damper plate, is installed to be rotatable about a shaft 232 in a cylindrical duct 210. The conventional variable air volume control apparatus controls air volume through a following process.

A room thermometer 250 (not shown in detail) installed indoors senses room temperature and transmits information thereof (a signal) to a controller 260 (not shown in detail). The controller 260 which received the information computes the information and currently set temperature from the room thermometer 250 to calculate the air volume needed.

Then, the controller transmits a signal for an open angle corresponding to the air volume needed, to operational devices such as a motor or an actuator 240 which are then operated accordingly. Also, the controller measures the air volume at an inlet side via an air volume measurement device such as an anemometer or a differential pressure sensor installed at the inlet side and transmits the information (signal) to the controller 260.

The controller 260 receives the information (signal) from the air volume measurement device and rotates the shaft 232 of the operational device as much as the excessive or deficient amount of air to adjust the open angle of the damper blade 230, thereby maintaining the air volume corresponding to the information (signal) from the room thermometer 250.

As the damper blade 230 is operated, a viewer looking through the air duct from the air input side near the air volume measurement device, such as above flow sensor 220 in the air duct, can see changes in the open air area above and around the leading edge of the damper blade 230 and below and around the trailing edge of the damper blade 230. Such open air area, designated $A_{open}$, is a function of the angle θ, with no open air area when the damper blade is fully closed at an angle θ=0° and with essentially a completely open air area when the damper blade 230 is fully opened at an angle θ=90°. At smaller opening ratios of θ/90°, that is, when the damper blade is opened at only small angles θ relative to the fully opened 90° position, the open air area that results is less than what results at larger opening ratios.

When the radius of the damper blade, designated $r_{damper}$, and the radius of the air duct, designated $R_{duct}$, are the same, it can be shown by the application of geometric formulas and mathematical calculations that the height of the open air area between the leading edge of the damper blade at its peak and the peak of the interior surface of the air duct, which measurement is here designated y for convenience of reference, is a function of the radius of the damper plate 230 and the angle θ, that may be conveniently expressed as $y=r_{damper}(1-\cos\theta)$, with the open air ratio thus corresponding to $y/r_{damper}=(1-\cos\theta)$.

However, the conventional air volume control apparatus 200 as shown in FIG. 1 is less than ideal in its operation, especially in that the resultant air volume change ratio, shown as plot C in FIG. 3, is a greatly deviating (distorted) curve rather than a line. Such distortion is a consequence of the non-linear characteristic of the open air ratio $y/r_{damper}$ relative to the opening ratio θ/90°, as represented by plot B of FIG. 3, as well as factors such as air overflow and friction between air flow and the inner surface of duct 210.

As shown in FIG. 3, the open area ratio curve B deviates greatly from the opening ratio line A, and thus the volume of air flowing through a corresponding open air area is far from being in direct proportion to the corresponding opening ratio. Therefore, the air volume change ratio C results in a curve which greatly deviates from the opening ratio line A.

As seen from the air volume change ratio curve, in a low opening ratio range of about 0 to 30%, i.e., in the range D1 of near closed state of the damper blade, the air volume change is too small with respect to the corresponding change of the opening ratio, thus difficult to adjust the air volume in this range. Also, in a high opening ratio range of about 70 to 100%, i.e., in the range D2 of near open state of the damper blade, the air volume change is too small with respect to the corresponding opening ratio, thus difficult to accurately and precisely adjust the air volume.

In addition, in the opening ratio range of 30% to 70%, the air volume changes drastically with respect to even a small change in the open angle, i.e., the opening ratio of the damper blade, hindering precise control of the air volume.

Therefore, in order to exclude the tendency of too small an air volume change with respect to the opening ratio in the range D1 of near closed state of the damper blade and achieve a linear form in the entire range of the opening ratio, in the conventional air volume control apparatus shown in FIG. 2, the damper blade 230 installed with the shaft 232 inside the duct 210 is modified into an oval plate shape and the closed position of the damper blade in the duct 210 is shifted about 30 degrees to an angle θ1 so that an adjustable range of angle θ2 is thereby shifted to be 30 degrees to 90 degrees.

Shifting the adjustable range of angle θ2 of the damper blade 230 to be from 30 degrees to 90 degrees, where an adjustable range is from 0 degrees to 60 degrees to yield 0% to 100% of air volume change, results in a drawback in which the adjustable range of angle is decreased by 33% from that with an adjustable range of 0 to 90 degrees to yield 0 to 100% of air volume change.

This means that the adjustable range of angle is too small to allow precise control of air volume.

Therefore, rather than reducing the adjustable angle range of the variable air volume control apparatus 200, the adjustable angle range of 0 to 90 degrees should be maintained to yield the air volume change of 0 to 100% in order to more accurately and precisely control the air volume.

Also, in order to change the air volume curve into a linear form, the open area should be increased at the low opening ratio.

This allows obtaining a linear air volume change in proportion to the opening ratio of the damper blade at a low opening ratio, thereby accurately and precisely controlling the air volume.

As confirmed above, the flow control damper is an essential component for adjusting the air volume introduced into the variable air volume control apparatus in an air conditioning system adopting a variable air volume control system. The capability of the flow control damper to linearly control the air volume plays a determining role in efficiently operating the variable air volume control apparatus.

Recently, the controller for the variable air volume control apparatus has been developed into a finely-operated electronic type, which is used in almost all air conditioning systems. However, if the variable air volume control apparatus does not have a linear flow characteristics of the flow control damper operated by the actuator 240, precise control of the variable air volume control apparatus cannot be efficiently realized, regardless of excellent capabilities and control of the controller of the variable air volume control apparatus and the highly accurate and reliable flow sensor for sensing air volume change at an inlet side of the variable air volume control apparatus or constant feedback control of the flow control damper by comparing and computing differential pressure signal from the flow sensor with the indoor temperature load change.

Air flows at the highest velocity in the central portion of a duct or conduit, and at a low velocity near the wall due to friction. Thus, when the damper blade is opened at the opening ratio of 100%, although the velocitymay somewhat change, the air volume flowing per unit of time approximates to 100% with substantially no inflow or outflow loss.

When the damper blade's opening ratio decreases by 50%, i.e., the damper blade 230 is biased at 45 degrees, the air volume is also supposed to be decreased by 50%. However, the actual air volume turns out to be less than 50%. This is because when the damper blade 230 is biased at 50% (45 degrees) in a cylindrical duct, the resultant open area ratio is too small at 29.29%, and thus the resultant air volume is also small at about 40% (see FIG. 3).

Also, when the opening ratio of the damper blade is 30% or less, the resultant open area ratio is too small at 10% or less with too small an air volume, hindering precise control.

In addition, when the open angle of the damper blade 230 is 70% or more, the resultant open area is smaller than the directly proportional line whereas too large a volume of air flows, hindering precise control.

As described above, in the conventional variable air volume control apparatus 200, the air volume change with respect to the opening ratio of the damper blade 230 turns out to be a greatly deviating (distorted) curve C as shown in FIG. 3, rather than a line.

In FIG. 3, the graph shows the open area ratio and air volume change ratio with respect to the opening ratio, obtained by the above conventional variable air volume control apparatus.

Therefore, as shown in the graph in FIG. 3, with the conventional air volume control apparatus 200, in the opening ratio range of 30% to 40% or less, the actual open area ratio curve B deviates greatly from the ideal open area ratio, i.e., line A which is in direct proportion to the opening ratio of the damper blade 230. As a result, accurate control of air volume is difficult.

Therefore, the conventional air volume control apparatus 200 cannot accurately control the air volume introduced indoors, thus having difficulty in supplying fresh air indoors while consuming more energy.

In order to overcome such a problem, Korean Utility Model Registration No. 0346769 (entitled "Dome Type Air Damper Unit") has been suggested. This conventional dome type air damper unit has a cylindrical body having flanges at opposed ends thereof. Inside the body, a wing unit, connected to a control unit, is connected to a plurality of wings at one side of the body, forming a dome-shape. The control unit adjusts the angle of the wings to operate the plurality of wings simultaneously, thereby changing an open area of an air outlet to adjust the air volume.

However, this conventional structure is structurally complex and expensive, yielding a non-linear air volume characteristics curve.

A different conventional technology has been suggested in Korean Utility Model Registration No. 0376799 (entitled "Variable Air Volume Control Apparatus").

In this conventional variable air volume control apparatus, a shaft is disposed movable back and forth and connected to a guide lever of a damper actuator disposed outside of the apparatus body and operated by a room thermometer. Also, a pair of symmetrical air volume control dampers are split or joined in accordance with the movement of a pair of links that are connected to an end of the shaft. And an air conduit is installed to connect between an air inlet and a first air outlet, and is connected to a mixed air outlet.

However, this structure is structurally complex, thus difficult to manufacture, and expensive. Further, it uses a guide lever in a link structure, which makes noise and the resultant air volume change ratio curve has non-linear characteristics.

A different structure from the above is disclosed in U.S. Pat. No. 5,333,835 (entitled "Electric Motor Driven Air Valve").

In this structure, a screw shaft is rotated by a motor to thereby move a damper blade connected to the screw shaft, adjusting the volume of air flowing between the open damper blade and the duct.

However, it is also difficult to accurately adjust the air volume according to the orbit of the damper blade with this conventional structure which is expensive and difficult to manufacture due to structural complexity.

SUMMARY OF THE INVENTION

The present invention has been made to solve the foregoing problems of the prior art and therefore an object of certain embodiments of the present invention is to provide a variable air volume control apparatus with excellent performance, capable of accurately adjusting air volume through simple structural improvements, and is low-cost.

Another object of certain embodiments of the invention is to provide a variable air volume control apparatus in which an air flow path is opened in proportion to opening ratio of a damper blade at a low opening ratio, thereby accurately adjusting air volume.

According to an aspect of the invention for realizing the object, there is provided a variable air volume control apparatus for varying air volume in a duct, including: a damper blade disposed rotatably within the duct for opening or closing an air flow path; an actuator for rotating the damper blade; an air flow path expansion mechanism having a curved surface for expanding the air flow path in accordance with an open angle of the damper blade.

By employing various preferred alternative embodiments of the invention, as briefly addressed in the alternative in the following paragraphs, a user can effectively increase or expand the open air area about a damper plate as it is being operated, especially when the damper blade is operating in a low opening ratio range of about 0% to 30%, and can thereby permit more desirable air flow volume through the air duct.

Preferably, the curved surface of the air flow path expansion mechanism expands and compensates the air flow path such that an open area is in direct proportion to an opening ratio corresponding to an open angle of the damper blade.

Preferably, the air flow path expansion mechanism comprises a ring structure installed on an inner surface of the duct, and the damper blade has a circumference the same as that of the ring structure.

Preferably, the ring structure has a circular inner periphery.

Preferably, the ring structure has an oval shape in which a horizontal or an axial diameter of the damper blade is larger than a vertical diameter.

Preferably, the air flow path expansion mechanism is a part of the duct that is constricted inward.

Preferably, the air flow path expansion mechanism is a part of the duct that is bulged outward.

Preferably, the damper blade has a shaft shifted upward or downward from a center of the duct.

Preferably, the damper blade is installed in a rectangular duct.

Preferably, the curved surface of the air flow path expansion mechanism is formed to compensate an open area of $(\theta/90)-(1-\cos\theta)$ at a low opening ratio, where $\theta$ is an arbitrary angle at which damper blade open from a closed position of the damper blade.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 4:
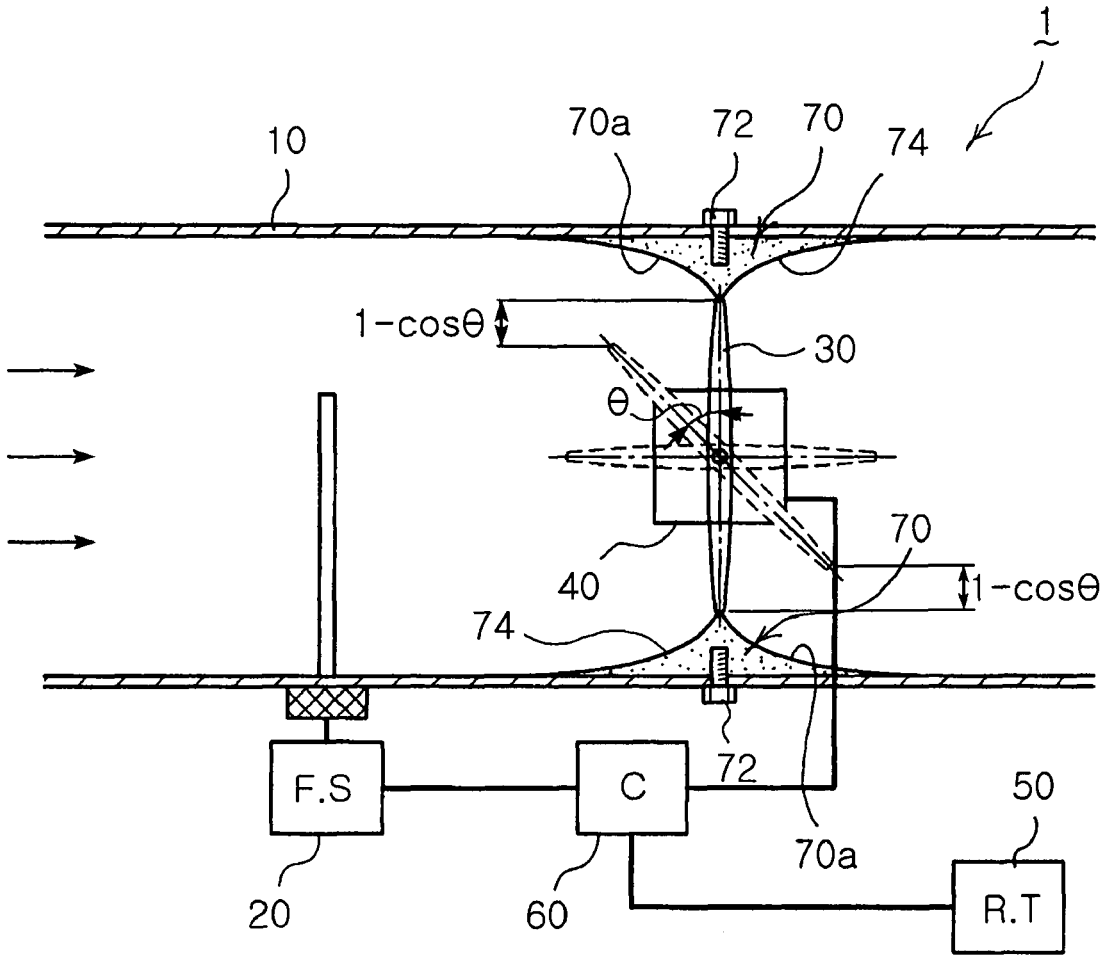
FIG. 4 is an overall configuration view illustrating a variable air volume control apparatus according to the present invention.

As shown in FIG. 4, the variable air volume control apparatus 1 according to the present invention is installed inside a duct 10 through which outside air is introduced and includes a flow sensor 20 for sensing air flow from the outside, a damper blade construction 30, hereinafter, for convenience of reference, referred to more simply as a damper blade or damper plate, for adjusting air flow introduced indoors from the outside, and an actuator 40 for rotating the damper blade 30.

Figure 5:
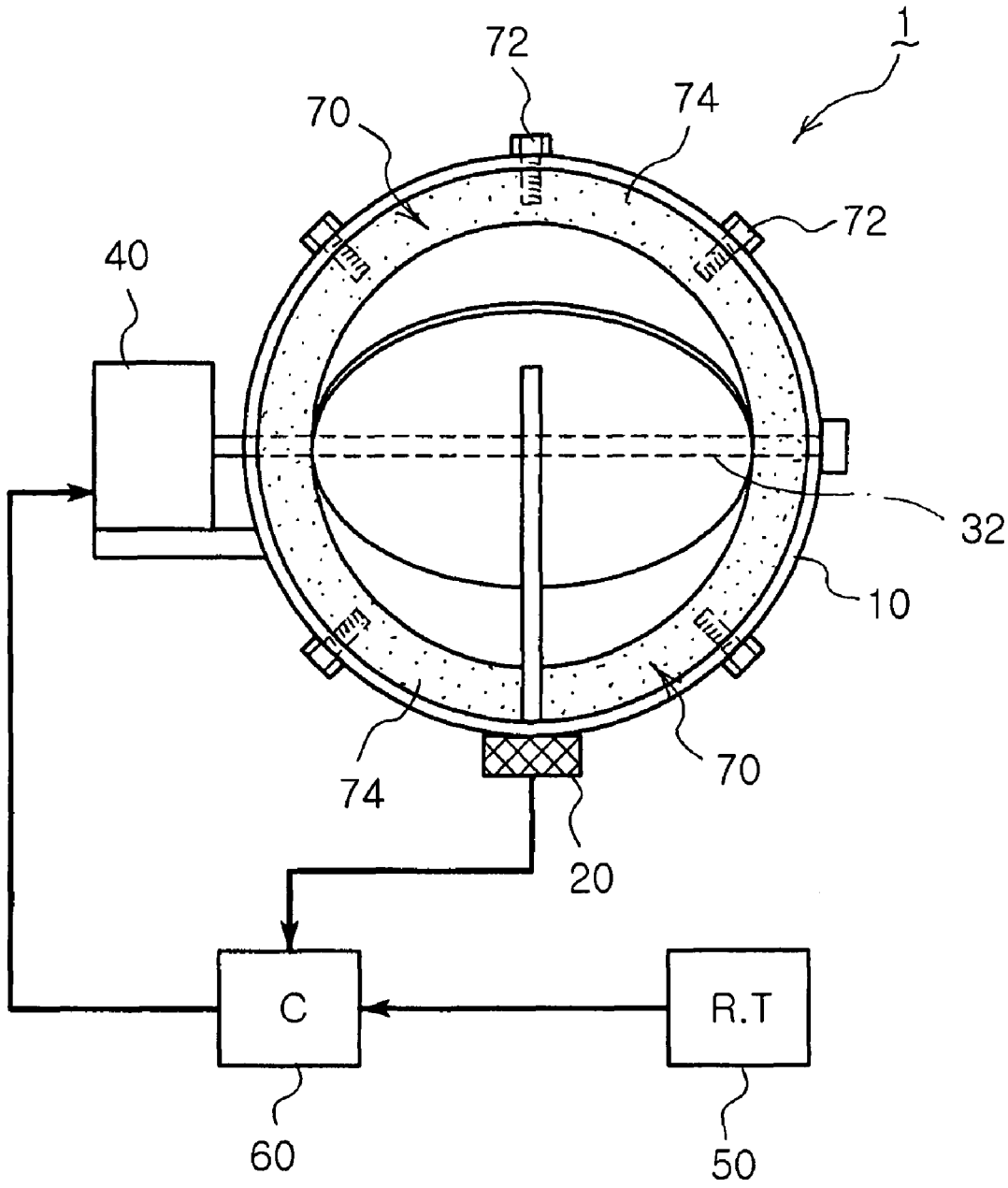
FIG. 5 is a cross-sectional view illustrating the variable air volume control apparatus according to the present invention.

As may be observed from FIG. 4, duct 10 has air input and air output portions of a generally uniform configuration on opposite sides of the damper blade 30. For purposes of further discussion and explanation, the inner circumference of the duct 10 at the air input and output portions thereof, such as is shown in FIG. 5 in cross-section, is considered to be the nominal inner circumference of the duct. For a cylindrical duct, the radius of the duct at the air input and output portions thereof is considered to be the nominal radius of the duct.

Also, the variable air volume control apparatus 1 includes a room thermometer 50 for detecting room temperature and a controller 60 for controlling the operation of the variable air volume control apparatus 1.

The flow sensor 20, the actuator 40 and the room thermometer 50 are electrically connected to the controller 60 to thereby be controlled.

However, as may be observed from FIGS. 4 and 5, in the present invention the damper blade or plate 30 has a smaller radius than does the air duct 10, and the variable air volume control apparatus 1 of the present invention includes an air flow path expansion mechanism 70 designed to effect an increase in air flow through the air duct when the damper plate operates in an opening ratio range of 0° to 30°, hereinafter referred to as the low opening ratio range. As depicted in FIG. 4, and as will be more fully explained hereafter, the air flow path expansion mechanism 70 is positioned along the duct 10 to form a constrictor portion that preferably includes an outer ring structure 74 that acts in conjunction with the smaller radius damper blade 30 of the present invention to effect the desired increase in air flow through the air duct. In effect, this is accomplished by expanding the air flow path, beyond what could be realized with the prior art constructions and the damper blades thereof with their larger radii, according to an open angle $\theta$ of the damper blade 30 as the damper blade 30 is opened.

The outer ring structure 74 preferably includes a rib portion disposed between air input and output side portions of the ring structure, with such rib portion projecting towards the center of the air duct to form a generally transverse ridgeline along the interior of the duct. The inner periphery of the ridgeline is the innermost circumference of the ring structure 74. Such ring structure 74 is installed in the air duct 10 such that, when the damper blade is fully closed, the ridgeline will be in generally planar alignment with the damper blade 30 and also such that its inner circumference of the ring structure at the ridgeline, that is, the inner circumference of the constrictor portion at the rib of ring structure 74, is oriented to adjoin the outer circumference of the damper plate 30. Consequently, when the damper plate is fully closed, that is, when the opening angle θ of the damper plate is 0°, there is no open air area through which air can flow through the air duct.

As can be observed from FIG. 4, the air input and output side portions of the ring structure 74 are preferably mirror images of one another and have concavely curved surfaces 70*a* that meet at the ridgeline of the rib portion and extend sidewardly therefrom along the duct 10 to meet the inner surface of duct 10. As is shown in FIG. 4, the ring structure 74, with its side surfaces 70*a*, preferably extends along duct 10 to be generally co-extensive with the damper blade 30 when the damper blade 30 is fully opened. Consequently, each side portion preferably extends along the duct from the ridgeline of the central rib portion a distance approximately equal to the radius r of the damper plate 30.

The curvature of the side surfaces 70*a* is preferably uniform along the entire extents of such curved side surfaces, from where such curved side surfaces meet at the ridgeline of the rib portion to where they meet the interior of duct 10. As a consequence, the height of the rib portion at the ridgeline is therefore approximately equal to the radius of the damper plate times (√2−1), that is $h_{rib}=r(\sqrt{2}-1)$, where $h_{rib}$ is the height of the rib and r is the radius of the circular damper blade 30, as can be readily mathematically calculated based upon geometric considerations of the design.

As can be observed from FIG. 4, the air flow path mechanism 70 thus defines an air flow channel through the duct 10 through which air can flow when the damper blade 30 is opened. Such channel has an inner circumference that varies from a larger value at the outermost edges of the curved side surfaces 70*a* where such side surfaces meet the interior of the duct 10 to a smaller value where such curved side surfaces meet at the ridgeline of the rib portion. Significantly, the varying inner circumference of the channel along the extents of the curved side surfaces 70*a* is greater than the outer circumference of the damper blade 30. In other words, the outer circumference of the damper blade 30 is smaller than the inner circumference of the air flow channel along the extents of the curved side surfaces at the air input and output sides of the damper blade 30. Inasmuch as the embodiment depicted in FIG. 4 employs a generally circular damper blade 30 installed within a generally cylindrical duct 10 of uniform nominal inner radius R and the air expansion mechanism 70 includes a ring structure 74 within the duct 10, that also means that, for the embodiment of FIG. 4, the radius r of the damper blade 30 is smaller than the nominal inner radius R of the duct 10.

Figure 1:
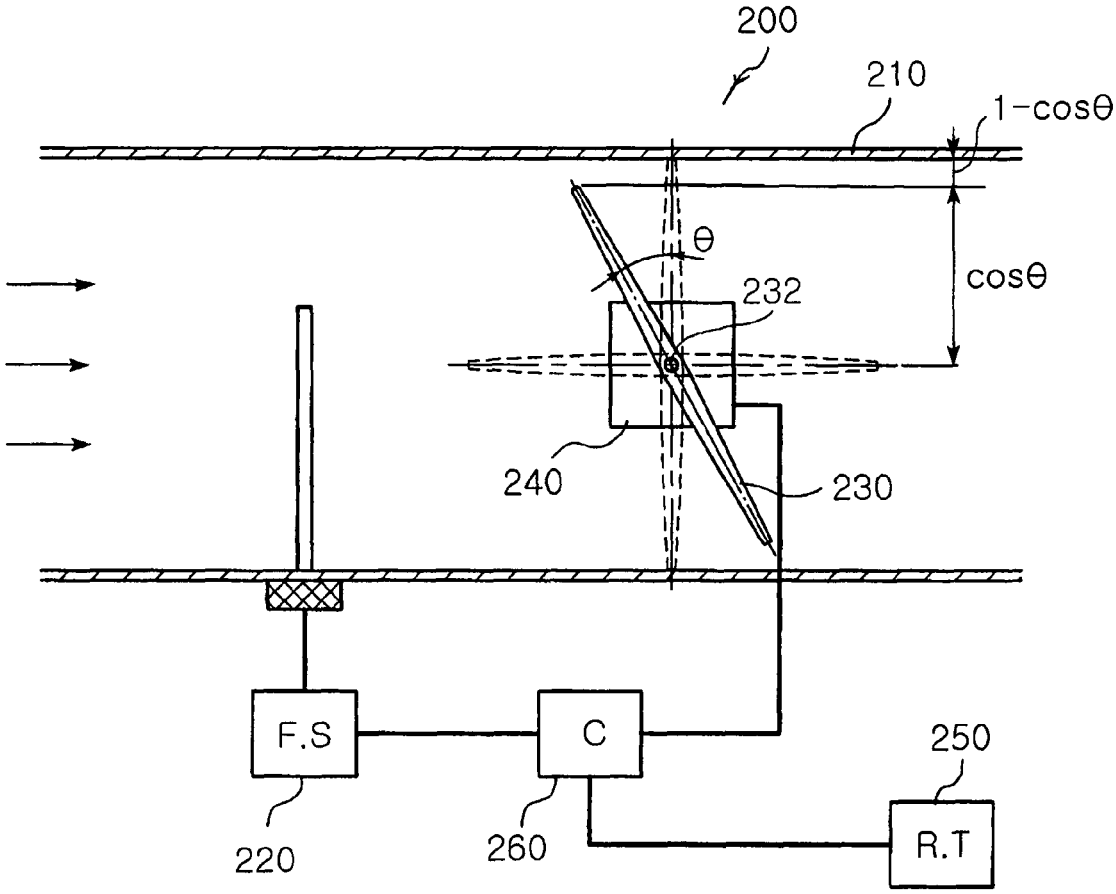
PRIOR ART FIG. 1
FIG. 1 illustrates a conventional air volume control apparatus.
Figure 2:
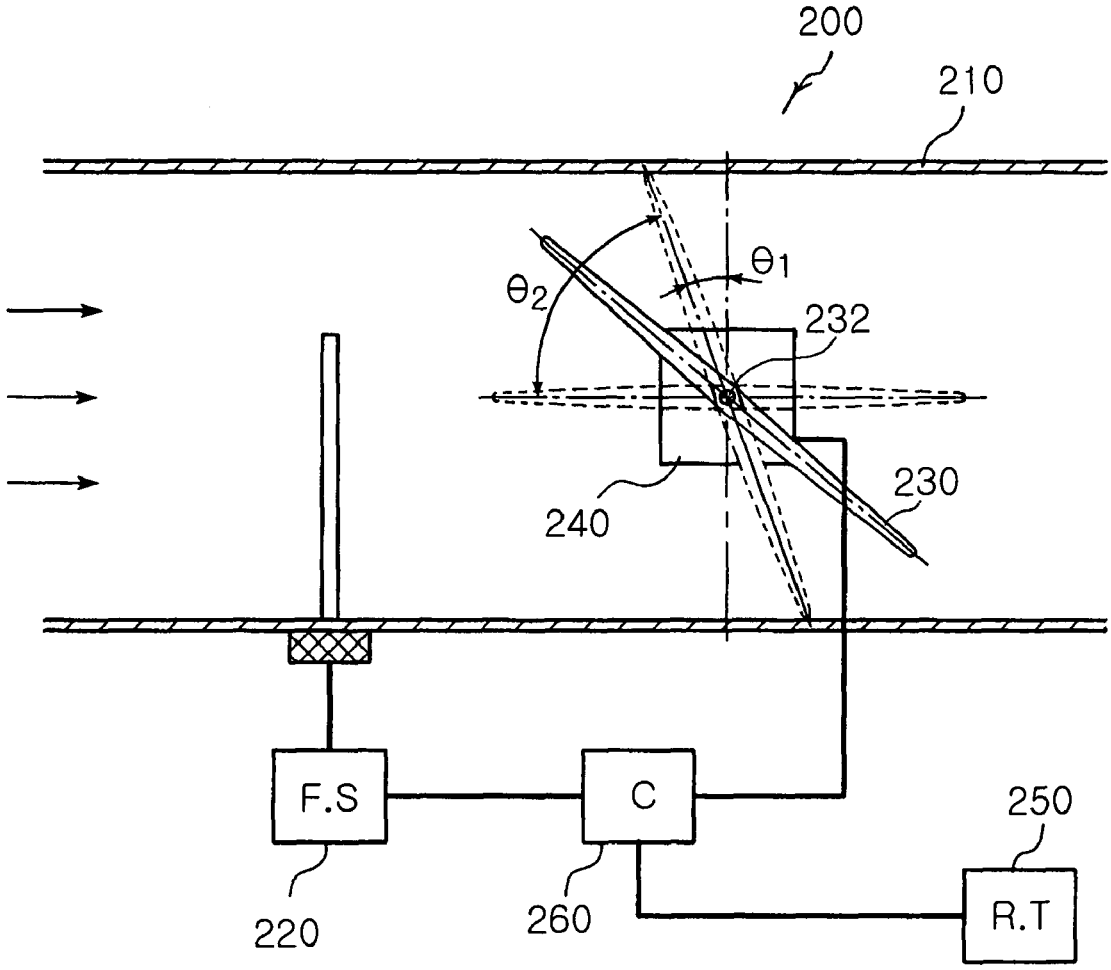
PRIOR ART FIG. 2
FIG. 2 illustrates another conventional air volume control apparatus.

When the damper blade 30 begins to open, a greater open air area results than would be the case with the prior art in that air is able to flow through a larger, or expanded, open air area that includes not only an area similar to the open air area discussed hereinabove relative to the construction of FIG. 1, hereinafter referred to as the base open air area, but also through an area that includes a portion of the area shown in dotted fashion in FIG. 5, around the outer periphery of the damper blade 30, which area is hereinafter referred to as the increased or compensatory open air area. The resultant expanded open air area for air flow should thus be recognized to include both the base open air area and the increased or compensatory open air area, and it should be appreciated that such expanded open air area is realized as a consequence of use of both the ring structure 74, and the air flow channel through the duct 10 defined thereby, and the damper blade 30 that has an outer circumference that is smaller than the inner circumference of the channel along the extents of the curved side surfaces 70a. The increased or compensatory open air area portion of the resultant expanded open air area compensates, in accordance with open angle θ of the damper blade 30, for the lower than desirable air flow that is realized in the low opening ratio range with the prior art devices.

From the discussions hereinabove, including the discussions of the prior art constructions, and especially the discussions regarding the construction of FIG. 1, it should be understood and appreciated, that, with the construction of FIG. 4 installed within the air duct 10, the amount of air flow through such air duct and through the expanded open air area as the damper plate operates is functionally related to the open air ratio θ/90°.

It should also be understood and appreciated, from the discussion in the foregoing paragraphs regarding the expanded open air area realizable with the present invention, that the base open air area may be represented by the boundary designations (1−cos θ) in FIG. 5. As has been previously explained hereinabove, the open air area achievable with the prior art construction was a function of (1−cos0), and it should therefore also be understood and appreciated that the base open air area realizable by the present invention, which corresponds generally to the open air area achievable with the prior art constructions, is likewise a function of (1−cos θ).

Since the expanded open air area realizable with the present invention includes both the base open air area and an increased or compensatory open air area, the increased or compensatory open air area is the open air area remaining when the base open air area is excluded from the expanded open air area. Since the expanded open air area is functionally related to θ/90° and since the base open air area is a function of (1−cos θ), the increased or compensatory open air area is therefore a function of both θ/90° and (1−cos θ), which is expressed hereinafter as [(θ/90°)−(1−cos θ)].

Those skilled in the art will understand and appreciate, from what has already been set forth hereinabove and from the further discussions that follow, that, with the present invention, as the damper blade 30 operates, air can thus flow not only through the base open air area, that is, through the open air areas as represented by the boundary designations (1−cos θ) in FIG. 5, but also through a portion of the circumferential area between the outer limits of the (1−cos θ) boundary designations and the curved surfaces 70*a* of the inner ring structure 74, which area is considered the increased or compensatory open air area. Consequently, the present invention effects an increased or compensatory open air area, in addition to the base open air area, as the damper plate begins to open at small angles of θ. With the present invention a greater air flow can then be realized than with the prior art construction of FIG. 1, the significance of which will be further addressed hereinafter, particularly relative to FIG. 6.

Figure 3:
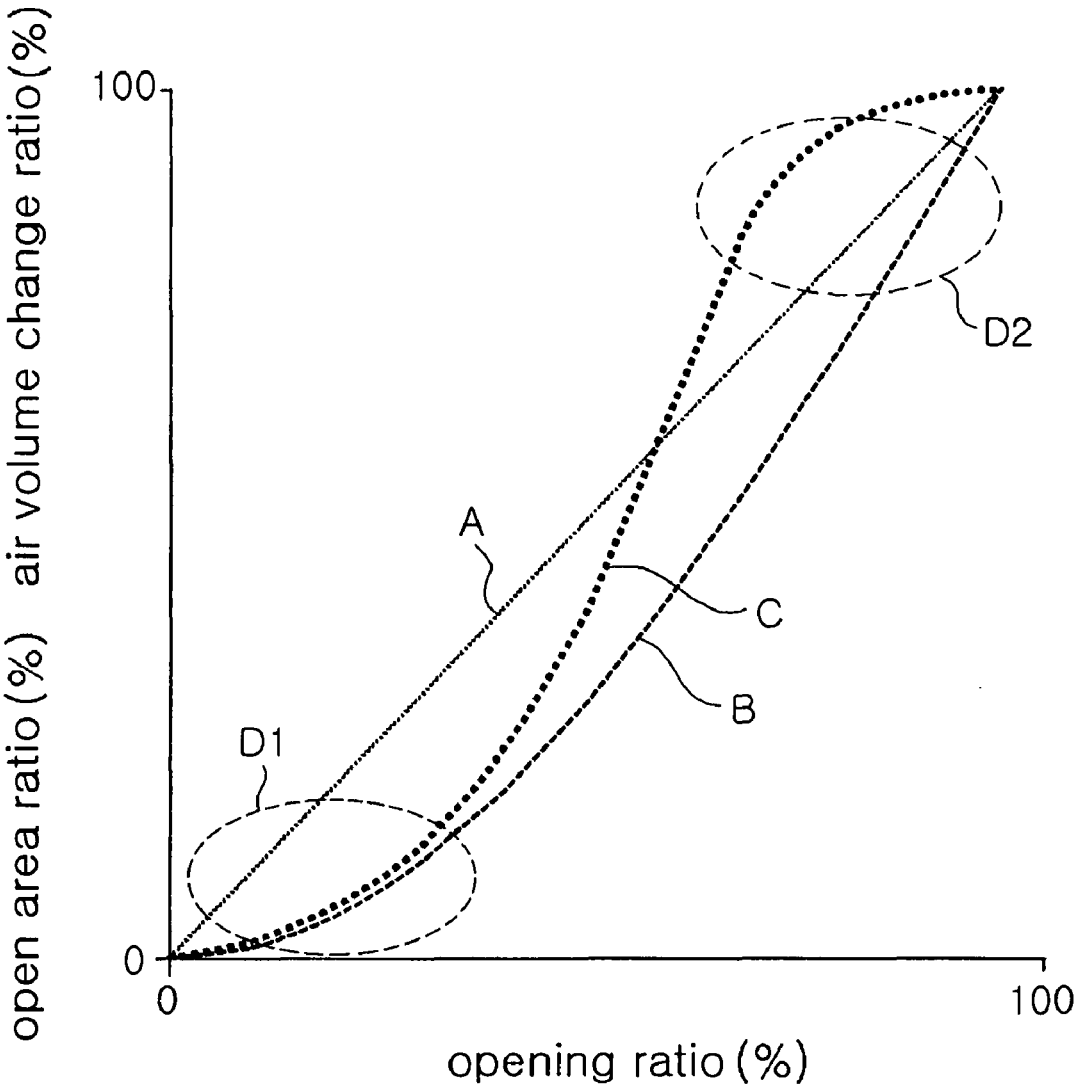
PRIOR ART FIG. 3
FIG. 3 is a graph showing the open area ratio and the air volume change ratio with respect to the opening ratio, obtained by the conventional variable air volume control apparatus.

The curved surfaces 70*a* of the air flow path expansion mechanism 70 serve not only to channel the air flow without creation of appreciable eddy currents and back pressure that could result if the air flow were to impinge upon a transverse flat surface extending or projecting into the flow path, but also to effect and enhance the more linearly responsive flow of air through the air duct 10 as the damper blade operates in a low operating range. As has been explained hereinabove, as the damper blade 30 is opened, an increased open air area beyond what could be realized with prior art constructions is effected. Such increased open air area compensates, at least in part, for the non-linear relationships that have been noted with respect to FIG. 3. The outer ring structure 74, with its curved side surfaces 70*a*, in conjunction with the damper blade 30 and its smaller radius, acts to effectively increase the amount of open air area for air flow beyond what could be realized with the prior art constructions, and to do so in such a way that the additional open air area realized, beyond that which could be realized due to operation of the damper blade alone in the prior art constructions, compensates for the lower than desired open air area and the deviating curve B as depicted in FIG. 3.

Figure 6:
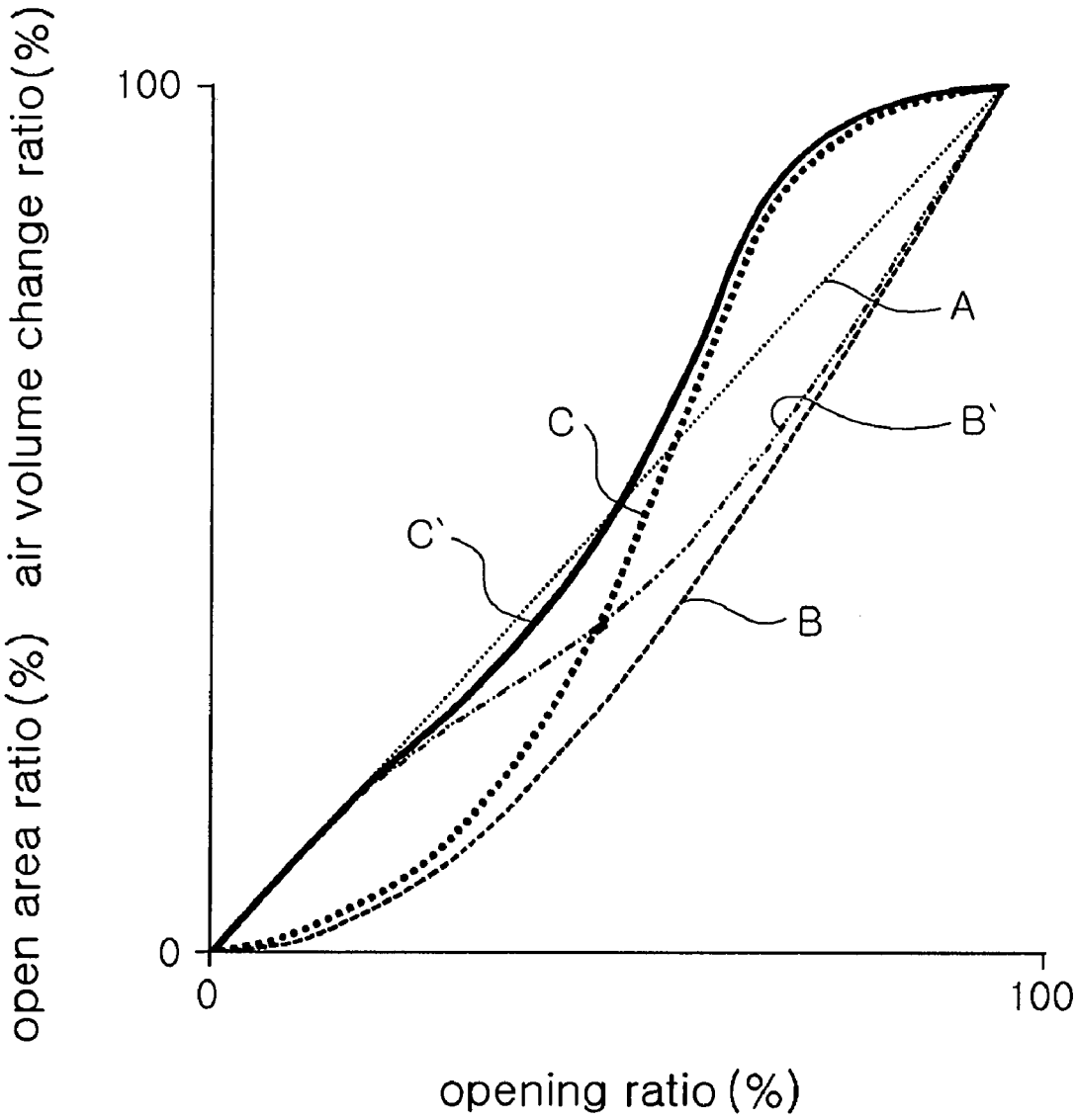
FIG. 6 is a graph showing the open area ratio and the air volume change ratio with respect to the opening ratio, obtained by the variable air volume control apparatus according to the present invention.

The present invention thus effects expanded open air areas of sizes functionally related to the opening ratios such that when the open air ratio values are plotted against opening ratio values, as depicted in FIG. 6, a more linear relationship results, as depicted by curve B' of FIG. 6. The increased or compensatory open air area, which can be viewed as the entire expanded open air area less the base open air area, expressed as $[(\theta/90°)-(1-\cos\theta)]$, effects a more effective air flow path according to the open angle of the damper blade 30. In particular, in a low opening ratio range (i.e., in the range of 0% to 30%), the air flow through the duct, realizable from use of the air flow path expansion mechanism 70 with the curved surface 70*a*, can be plotted as curve C' of FIG. 6 in accordance with the open air ratio in direct proportion to the open angle.

The air flow path expansion mechanism 70 can be installed on an inner surface of the duct 10 by a plurality of screws 72 penetrating through the duct 10 from the outside to fix the ring structure 74 on the inner side of the duct 10. The damper blade 30 is disposed inside the ring structure 74, and the rotation shaft 32 penetrates through the ring structure 74 and the duct 10 to enable rotation of the damper blade 30.

One end of the rotation shaft 32 is extended through the duct 10 and is connected to an operator 40 to be rotated forward and backward.

The curved surface 70*a* expands and compensates the open area for an area corresponding to $[(\theta/90°)-(1-\cos\theta)]$ at a low opening ratio, i.e., 0% to 30%. At an opening ratio greater than 30%, the open air area is no longer appreciably expanded or compensated. Thus at an opening ratio of up to 30%, the open area ratio is expanded and compensated to have directly proportional characteristics with respect to the opening ratio.

In addition, such a curved surface 70*a* extends from a portion of the duct 10 corresponding to an end portion of the damper blade 30 vertically positioned to a portion of the duct 10 corresponding to an end portion of the damper blade 30 horizontally positioned. In the upper region with respect to the rotation shaft 32, the curved surface 70*a* is installed in the air inlet side or the front side of the duct, and in the lower region, it is installed in the air outlet side or the backside of the duct 10.

When the damper blade 30 is opened at an arbitrary open angle θ at a low opening ratio (0 to 30%), conventionally, the damper blade 30 is opened by an open area ratio corresponding to $1-\mathrm{COS}\,\theta$. However, according to the present invention, as shown in FIG. 4, the curved surface 70*a* of the ring structure 74 compensates the open area ratio by $(\theta/90)-(1-\mathrm{COS}\,\theta)$ to obtain a linear open area ratio approximating to the opening ratio.

Figure 7:
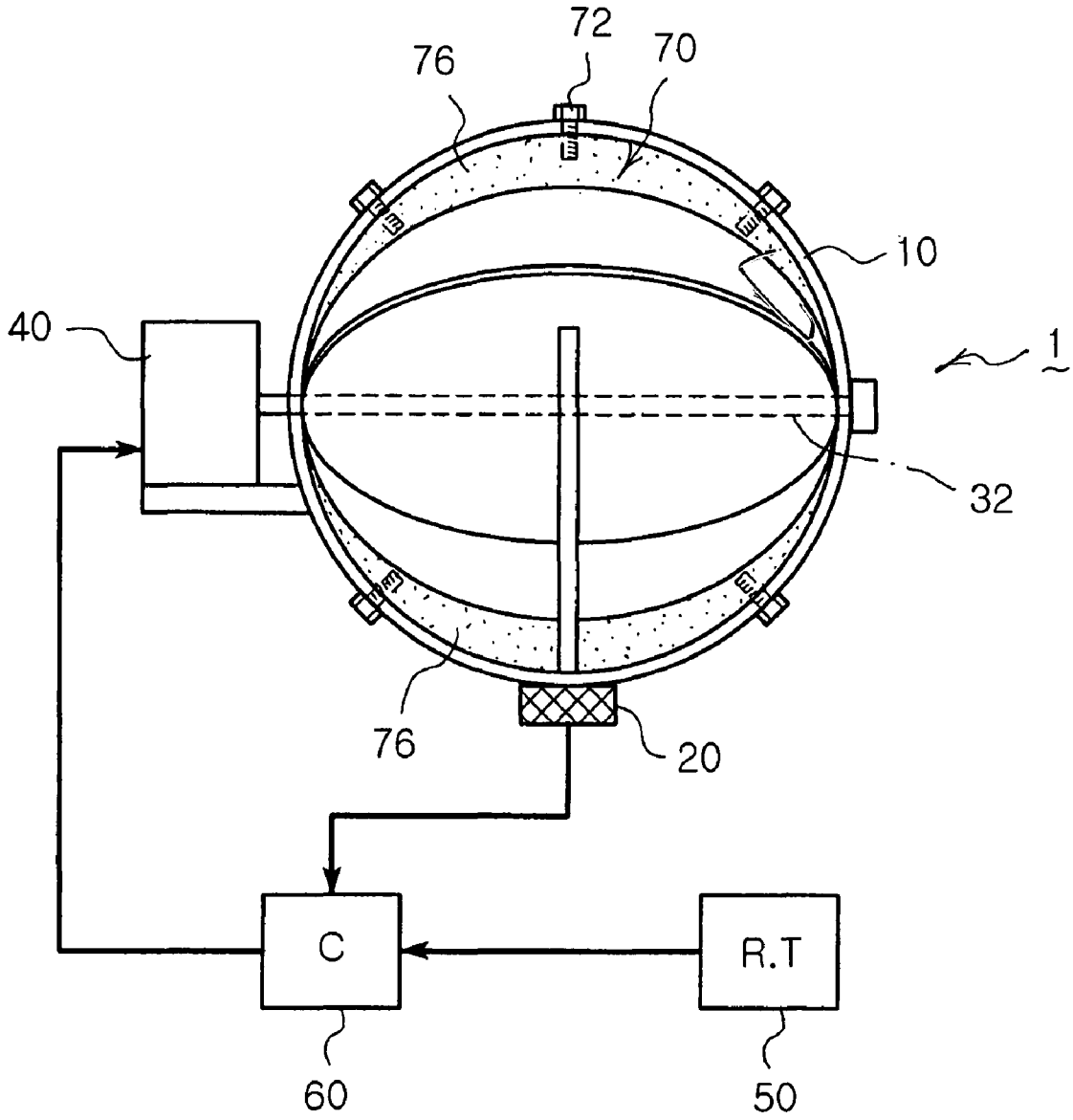
FIG. 7 is a cross-sectional view illustrating an alternative embodiment of the variable air volume control apparatus according to the present invention, in which an air flow path expanding mechanism having an oval inner periphery.

Alternatively, rather than having a circular damper blade and a ring structure 74 with a circular inner periphery, such as are depicted in FIG. 4, the air flow path expansion mechanism 70 according to the present invention can have, as depicted in FIG. 7, a damper blade of an oval construction in conjunction with a ring structure 76 with an oval inner periphery in which the major diameter of the formed ovals along the shaft 32 of the damper blade (being the horizontal diameter of the ovals in FIG. 7) is larger than the minor diameter of the ovals transverse to the shaft 32.

Such a structure as shown in FIG. 7 ensures more space in the air flow path of the duct 10 while facilitating installation of the rotation shaft 32 of the damper blade.

Figure 8:
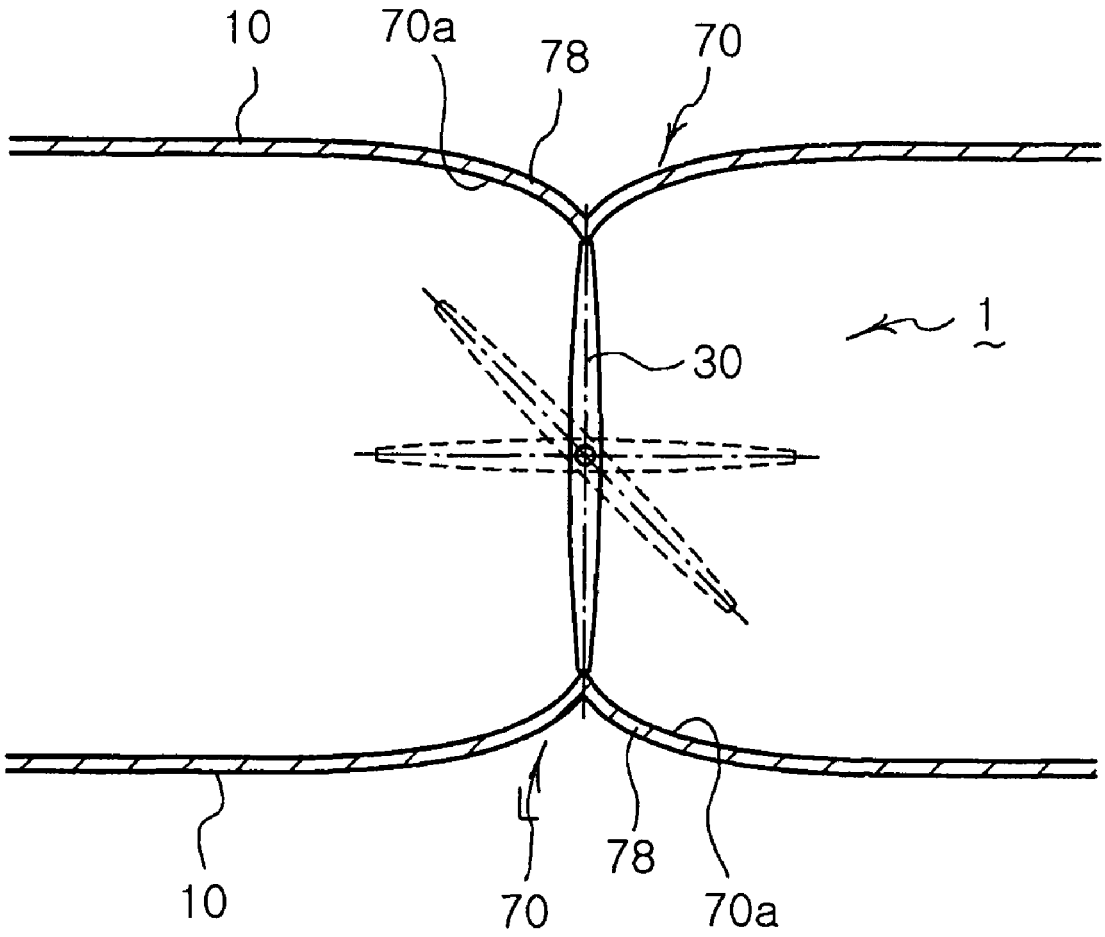
FIG. 8 is a side sectional view illustrating another alternative embodiment of the variable air volume control apparatus according to the present invention, in which the air flow path expansion mechanism is a part of the duct that is constricted inward.

In addition, in another alternative embodiment, the air flow path expansion mechanism 70 may preferably be a part of the duct 10 having a constricted part 78. As shown in FIG. 8, the duct 10 is machined to have the constricted part 78 constricted inward of the duct 10 to form a rib portion with a ridgeline at the inner periphery of the constriction. When the damper blade 30 is opened, the curved surface 70*a* of the air flow path expansion mechanism 70 effects an expanded open air area that, when a base open air area corresponding to $(1-\cos\theta)$ is excluded therefrom and from the air flow path at a low opening ratio range, i.e., 0% to 30%, the remaining open air area is an increased or compensatory open area. The resultant expanded open air area realized as the damper blade opens is thus in accordance with the open air ratio in direct proportion to the opening ratio.

Such a structure can be formed to have a constrictor portion without the need for an additional separate ring structure, and can be formed by machining the duct 10, and thus can be adopted in the present invention without additional costs of material.

The constricted part 78 also has the curved surface 70*a* for expanding the open area to effect an increase in the open area in accordance with $[(\theta/90)-(1-\cos\theta)]$.

Figure 9:
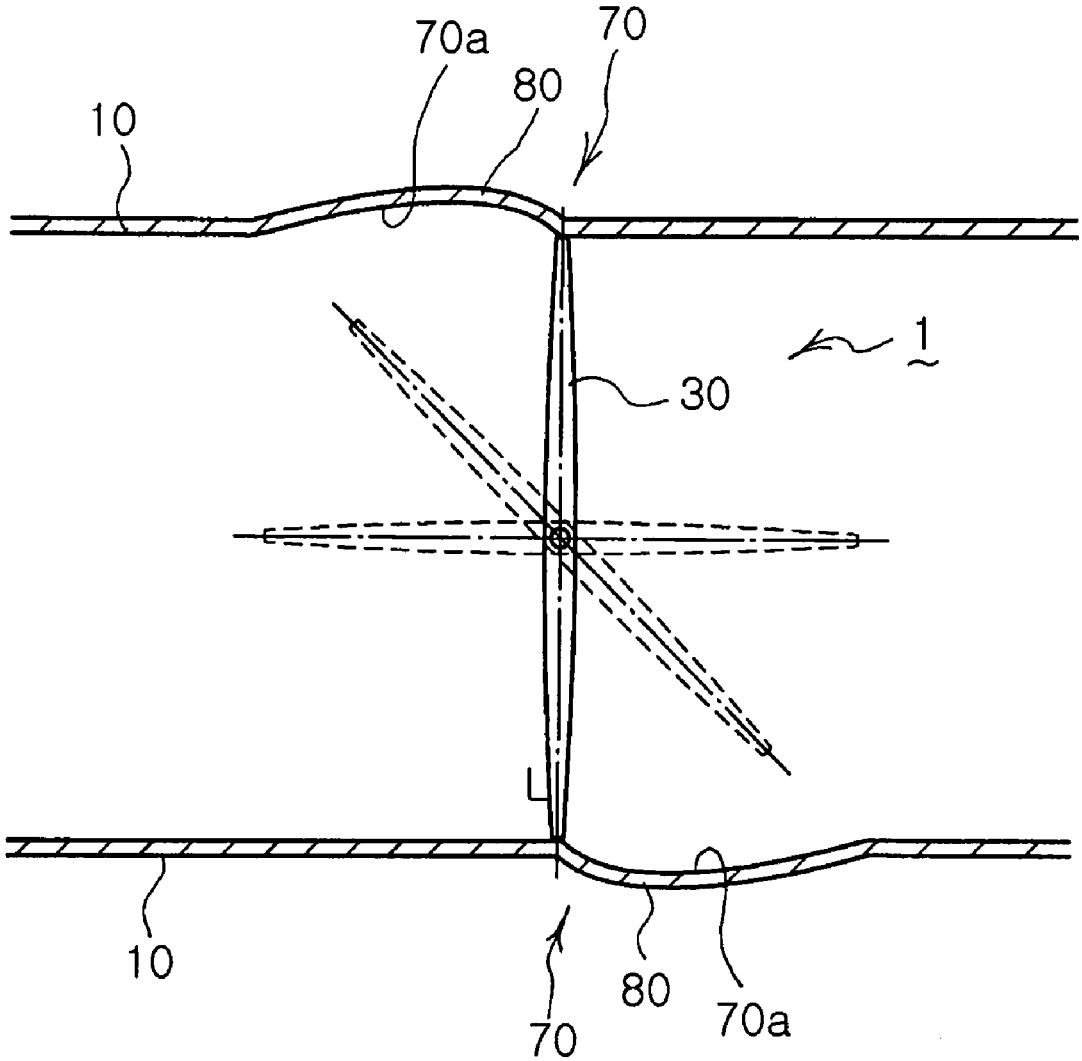
FIG. 9 is a side sectional view illustrating yet another alternative embodiment of the variable air volume control apparatus in which the air flow path expansion mechanism is a part of the duct that is bulged outward.

Alternatively, as shown in FIG. 9, the air flow path expansion mechanism 70 can also be a structure forming a constrictor portion in which the duct 10 is machined to have a bulged part 80 bulged outward of the duct 10, which bulged part 80 includes concavely curved inwardly facing surfaces that meet at a ridgeline that closely adjoins the outer circumference of the damper blade 30 when the damper blade is fully closed. The channel formed by the bulged part 80 of the air flow expansion mechanism 70 has a varying inner circumference on both the air input and air output sides of the ridgeline, which inner circumference is greater than the outer circumference of the damper blade 30. As with prior art constructions, when the damper blade is opened to an open angle θ at a low opening ratio (0% to 30%), a base open air area corresponding to $(1-\cos\theta)$ is realized, as has been explained hereinabove. From the foregoing discussions, however, it should be understood and appreciated that, with this bulged part 80 bulged outward of the duct 10, the air flow expansion mechanism 70 with its curved surface 70*a* of the bulged part 80 also effects an increase in the open air area in accordance with $[(\theta/90)-(1-\cos\theta)]$ to result in a linear open area ratio approximating to the opening ratio.

While it is generally desirable that the air input and air output sides of the air flow expansion mechanism extend along the duct from the central rib portion around the entire periphery of the constrictor portion, such as is depicted in FIGS. 4, 5, 8, and 10, the air input and air output sides need not necessarily be identical to one another and may, as depicted in FIG. 9, extend from the ridgeline of the rib portion only around a portion of the inner periphery of the constrictor portion and be offset from one another. With such offset air input and air output sides, and depending upon the amount of bulge and the curvature of the inner surfaces of the bulged parts 80, some degradation in the realized linearity of the open air area ratio curve B' may result, but the resultant open air area ratio curve will still be improved over the curve B of FIG. 3, at least within the low opening ratio of 0% to 30%.

Such a structure does not require an additional ring structure, and can be formed by machining the duct 10, and thus can be adopted in the present invention without additional costs of material. Also, the structure does not cause decrease in the air volume in the duct 10.

In addition, according to a certain embodiment of the present invention, the damper blade 30 has its rotation shaft 32 shifted upward or downward from a center P of the duct 10.

Figure 10:
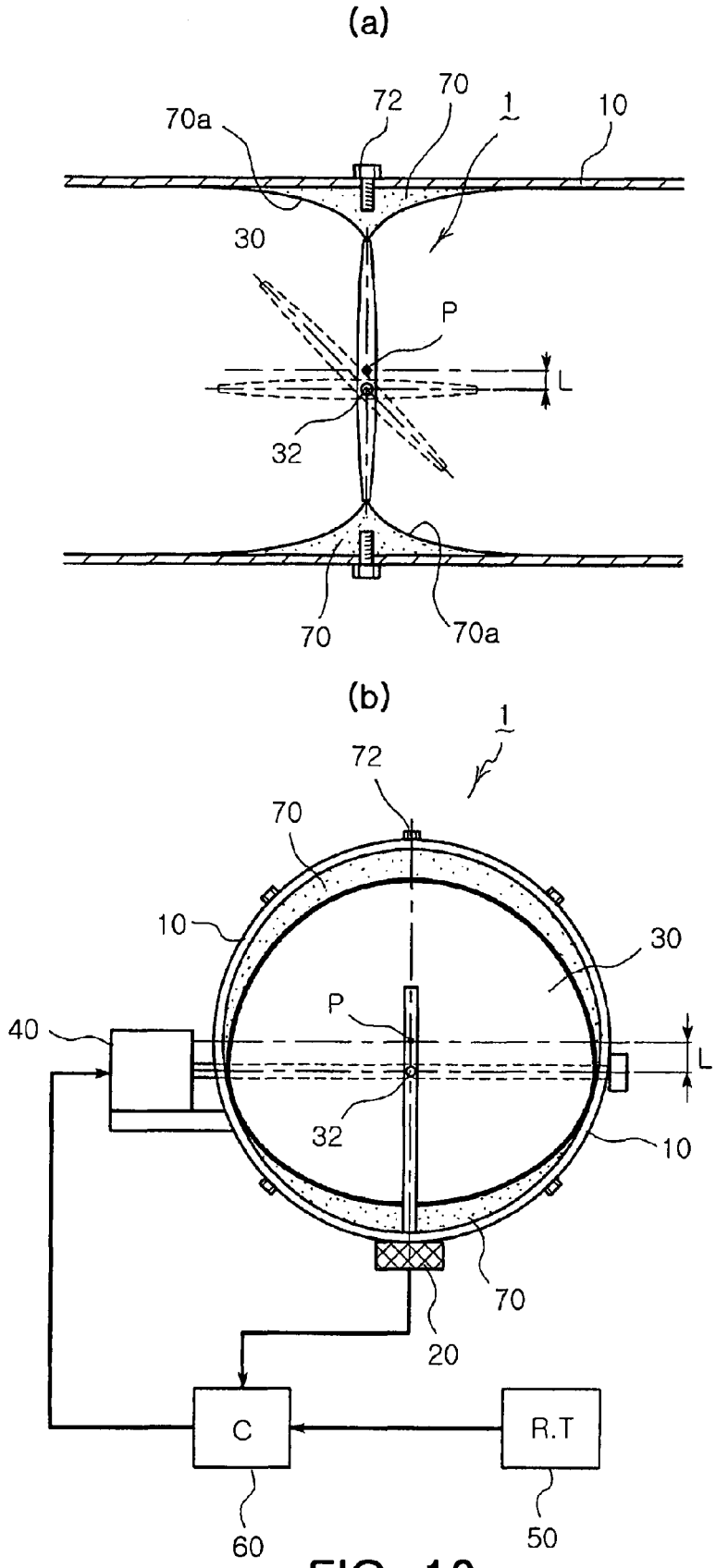
FIG. 10 illustrates a further another alternative embodiment of the variable air volume control apparatus according to the present invention, in which a shaft of the damper blade is shifted downward.

As shown in FIG. 10(*a*) and 10(*b*), the rotation shaft 32 is shifted in a predetermined distance L downward from the center P of the duct 10.

In this case, the damper blade 30 may be a structure other than a circular plate, but the air flow path expansion mechanism 70 may still be a ring structure having an inner periphery the same as the outer periphery of the damper blade 30, or a part of the duct 10 having a constricted part.

In the above, a downwardly shifted position of the damper blade 30 is presented, but an upwardly shifted position can also be adopted.

The invention is also effectively applicable to a duct 10' having a rectangular cross-section in addition to a circular cross-section. In this case, the air flow path expansion means 70 can be composed of first and second curved structures 82*a* and 82*b* separated into upper and lower parts rather than a ring structure, and can be fixed to the upper and lower inner surfaces of the duct 10', respectively.

Figure 11:
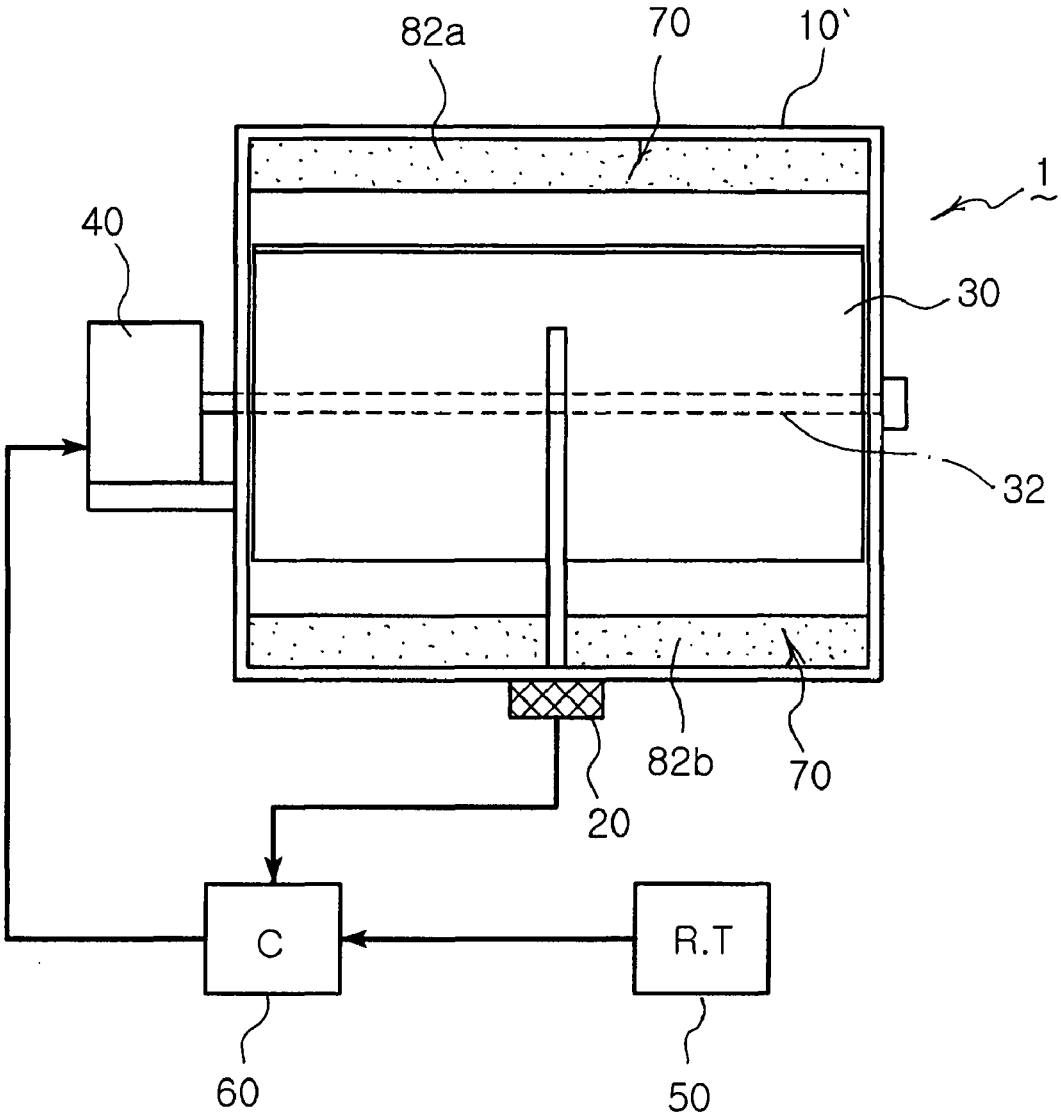
FIG. 11 is a side sectional view illustrating further another alternative embodiment of the variable air volume control apparatus according to the present invention including a rectangular duct.

As shown in FIG. 11, in such a structure, the first and second curved structures 82*a* and 82*b* have curved surfaces, respectively, and are part of the air flow path mechanism 70 that functions, in conjunction with the damper blade 30, to effect an open air area, in accordance with θ/90° as the damper blade 30 opens. Such resultant open air area includes not only a conventional or base open air, such as was realizable with prior art constructions such as that of FIG. 1, which base open air area corresponds to (1−cos θ), but also an increased or compensatory open air area corresponding to [(θ/90°)−(1−cos θ)].

As shown in FIG. 4, the air volume control apparatus 1 with the above described configuration is operated in the range from the vertical position of the damper blade 30 to completely block the air flow path at 0 degrees to an arbitrary angle θ at which the damper blade 30 is opened to the horizontal position of the damper blade 30 to completely open the air flow path at 90 degrees.

As the air volume control apparatus 1 is operated as above, when the damper blade 30 is open in an arbitrary angle θ (at a low opening ratio of about 0% to 30%), the actual open air area resulting from operation of the damper blade 30 in conjunction with the air flow expansion mechanism 70 is thus the sum of the conventional, or base, open air area, corresponding to (1−cos θ), and the increased or compensatory open air area, corresponding to [(θ/90°)−(1−cos θ)], at the arbitrary angle. As a result, this summed open air area corresponds to θ/90°, which yields an open air area directly proportional to an arbitrary angle θ, i.e., opening ratio of the damper blade 30.

FIG. 6 illustrates a graph showing the improved open area ratio and air volume change ratio with respect to the opening ratio by the present invention.

The open area ratio curve B' shown in FIG. 6, improved by the present invention is in direct proportion to the opening ratio curve A at a low opening ratio (0% to 30%).

As described above, in the present invention, when the damper blade 30 is open in an arbitrary angle θ from a closed position completely blocking the air flow path, for example, open at 9° (at the opening ratio of 10%), the air flow path expansion mechanism 70 expands and increases the open area of the air flow path by [9°/90°−(1−cos 9°)]. When the damper blade 30 is further opened up to 27° (the opening ratio of 30%), the air flow expansion mechanism 70 expands and increases the open air area of the air flow path by [27°/90°−(1−cos 27°)], thereby increasing air flow volume.

In addition, at the opening ratio of 30% (27°) or more, the present invention yields the open area ratio curve that is similar to the open area ratio curve B with respect to the opening ratio of the damper blade 30 without any compensation.

As described above, the open area ratio with respect to the opening ratio is improved significantly from the conventional curve B to have direct proportional characteristics at an opening ratio of 30% or less, i.e., an open angle of 27° or less.

Thereby, at an opening ratio of 0 to 50%, the air volume change ratio with respect to the opening ratio is improved to have linear characteristics to achieve more accurate and precise air volume control.

As set forth above, certain embodiments of the present invention permit the open air area ratio to approximate the opening ratio through simple structural improvements by the air flow path expansion mechanism, thereby achieving more accurate and precise air flow volume control.

Also, according to certain embodiments of the invention, installing the simple air flow path expansion mechanism allows accurate control of the air volume and a low-cost air volume control apparatus having excellent capabilities.

Certain exemplary embodiments of the invention have been explained and shown in the drawings as presently preferred. The invention may, however, be embodied in many different forms and should not be construed as limited to the embodiments set forth herein. While the present invention has been shown and described in connection with the preferred embodiments, it will be apparent to those skilled in the art that modifications and variations can be made without departing from the spirit and scope of the invention as defined by the appended claims.

What is claimed is:

1. A variable air volume control apparatus for varying air volume in a duct having a passageway therethrough defining an air flow path, comprising:

a damper blade construction that has an outer circumference and is disposed within the duct to be rotatable between a fully closed position generally transverse to the duct and a fully open position generally aligned with the duct for opening or closing the air flow path through the duct;

an actuator for rotating the damper blade;

an air flow path expansion mechanism for providing an open air area through which air can flow as the damper blade construction is opened and to control the air flow path in accordance with an open angle of the damper blade, said mechanism positioned at a point along the duct to form a constrictor portion with a generally central rib portion and oppositely disposed side portions extending sidewardly from said rib portion along the duct, said rib portion projecting inwardly relative to said side portions and generally transversely to the duct towards the center of the duct to form a ridgeline to closely adjoin at least a portion of the outer circumference of said damper blade construction when said damper blade construction is in its fully closed position, said side portions including concavely curved surfaces facing inwardly towards the duct, said curved surfaces meeting at said ridgeline and extending sidewardly from said rib portion along the duct, said constrictor portion having an inner circumference at said ridgeline approximately the same as the outer circumference of said damper blade construction such that, when said damper blade construction is in its fully closed position, said constrictor portion and said damper blade construction generally close the air flow path through the duct, said mechanism defining a channel portion of varying inner circumference within the duct along the extent of said mechanism, said varying inner circumference of said channel along said side portions of said mechanism being greater than said outer circumference of said damper blade construction;

whereby, as said damper blade construction is operated within a low opening ratio range of about 0% to 30%, the open air area for air flow through the duct is increased in an approximately linear relationship with the opening ratio and said rib portion has a height at said ridgeline equal to approximately $(\sqrt{2}-1)$ times the radius of said damper blade construction.

2. The variable air volume control apparatus according to claim 1, wherein the inwardly facing surfaces of the air flow path expansion mechanism are so curved to effect an open air area that includes a base open air area and a compensatory open air area through which air can flow in the air flow path and such that the open air area is in generally direct proportion to an opening ratio corresponding to an open angle of the damper blade.

3. The variable air volume control apparatus according to claim 2, wherein the air flow path expansion mechanism comprises a ring structure installed on an inner surface of the duct.

4. The variable air volume control apparatus according to claim 3, wherein the ring structure has a circular inner periphery.

5. The variable air volume control apparatus according to claim 3, wherein the ring structure has an oval shape in which a horizontal or an axial diameter of the damper blade construction is larger than a vertical diameter.

6. The variable air volume control apparatus according to claim 1, wherein the duct has a nominal inner circumference, the air flow path expansion mechanism is a part of the duct that is constricted inward, and said damper blade construction has an outer circumference that is smaller than the nominal inner circumference of the duct.

7. The variable air volume control apparatus according to claim 1, wherein the air flow path expansion mechanism is a part of the duct that is bulged outward.

8. The variable air volume control apparatus according to claim 1, wherein the damper blade construction has a shaft shifted upward or downward from a center of the duct.

9. The variable air volume control apparatus according to claim 1, wherein the duct within which the damper blade construction is installed has a generally rectangular cross section.

10. The variable air volume control apparatus according to one of the preceding claims 1 to 9, wherein the curved surface of the air flow path expansion mechanism effects an open air area that includes a base open air area and also a compensatory open air area as a function of $[(\theta/90°)-(1-\cos\theta)]$ at a low opening ratio, where $\theta$ is an arbitrary angle at which the damper blade is open from a closed position.

11. The variable air volume control apparatus according to claim 4, wherein said curved surfaces have a generally uniform radius of curvature in their extents along the duct from said ridgeline of said rib portion.

12. The variable air volume control according to claim 11, wherein the duct has a generally circular cross-section, said damper blade construction is generally circular in design.

13. The variable air volume control according to claim 1, wherein said curved surfaces of said side portions extend sidewardly from said ridgeline of said rib portion along the duct such that, when said damper blade is at its fully open position, said air flow path expansion mechanism extends along the duct a distance to be generally co-extensive with said fully opened damper blade construction.

14. The variable air volume control according to claim 1, wherein said side portions include an air input side and an air output side, said air input and air output sides each extending sidewardly from said ridgeline of said rib portion along the duct around the entirety of the inner circumference of said constrictor portion at said ridgeline.

15. The variable air volume control according to claim 1, wherein said side portions include an air input side and an air output side, at least one of said air input and air output sides extending sidewardly from said ridgeline of said rib portion along the duct around only a portion of the inner circumference of said constrictor portion at said ridgeline.

16. The variable air volume control according to claim 14, wherein said air input and air output sides are offset from one another around the inner circumference of said constrictor portion at said rib portion.

* * * * *